US011320172B1

(12) United States Patent
Walker, Jr.

(10) Patent No.: US 11,320,172 B1
(45) Date of Patent: May 3, 2022

(54) AIR CONDITIONER SHUT-OFF SYSTEM AND METHOD TO PREVENT DRAINAGE OVERFLOW

(71) Applicant: David Todd Walker, Jr., Palm Beach Gardens, FL (US)

(72) Inventor: David Todd Walker, Jr., Palm Beach Gardens, FL (US)

( * ) Notice: Subject to any disclaimer, the term of this patent is extended or adjusted under 35 U.S.C. 154(b) by 0 days.

(21) Appl. No.: 17/541,780

(22) Filed: Dec. 3, 2021

(51) Int. Cl.
*F24F 11/88* (2018.01)
*F24F 13/22* (2006.01)

(52) U.S. Cl.
CPC ..... *F24F 13/222* (2013.01); *F24F 11/88* (2018.01)

(58) Field of Classification Search
CPC ..... F24F 11/88; F24F 13/22; F24F 13/222; F24F 2013/227
See application file for complete search history.

(56) References Cited

U.S. PATENT DOCUMENTS

| | | | | |
|---|---|---|---|---|
| 1,237,937 | A | 8/1917 | Melin | |
| 1,651,034 | A | 11/1927 | McIntosh | |
| 2,004,194 | A | 6/1935 | De Lacy-Mulhall | |
| 2,520,820 | A | 8/1950 | Williams | |
| 2,708,435 | A | 5/1955 | Lewis | |
| 2,724,401 | A | 11/1955 | Page | |
| 3,766,936 | A | 10/1973 | O'mera | |
| 3,818,874 | A | 6/1974 | Tria | |
| 4,007,856 | A | 2/1977 | Murphy et al. | |
| 4,273,259 | A | 6/1981 | Koeneker | |
| 10,933,452 | B1 * | 3/2021 | Scaringe | F24F 13/222 |
| 2002/0000093 | A1 * | 1/2002 | Lea | F24F 13/222 62/150 |
| 2021/0215390 | A1 * | 7/2021 | Ramasamy | F24F 13/22 |

FOREIGN PATENT DOCUMENTS

| | | |
|---|---|---|
| FR | 431941 | 11/1911 |

* cited by examiner

*Primary Examiner* — Marc E Norman
(74) *Attorney, Agent, or Firm* — The Concept Law Group, PA; Scott D. Smiley; Scott M. Garrett

(57) ABSTRACT

An air conditioner shut-off system includes an overflow conduit that is coupled, at one end, to the drainage system of an air handler unit of the air conditioner system. The opposite end of the overflow conduit is positioned over an overflow container, which is suspended by a harness at the lower end of the harness. The upper end of the harness being operably coupled to the breaker throw of the main breaker, which is provided on or proximate to the air handler unit. If the drainage system becomes obstructed, water will flow into the overflow container through the conduit, and eventually the mass of the water accumulated in the overflow container will produce enough force acting on the breaker throw through the harness to flip the breaker throw to the OFF position and shut off the air conditioner system.

20 Claims, 12 Drawing Sheets

AIR CONDITIONER SHUT-OFF SYSTEM AND METHOD TO PREVENT DRAINAGE OVERFLOW

FIELD OF THE INVENTION

The present invention relates generally to shut-off controls for air conditioner system air handlers, and, more particularly, relates to a physical shut off that is triggered and operated by a drainage water overflow condition.

BACKGROUND OF THE INVENTION

There are many types of air conditioner (AC) systems in use. In general AC systems fall into one of two categories; self-contained units and split systems. In a self-contained unit, the compressor coil and evaporator coil are contained in the same housing or unit. Examples of self-contain AC systems include window and through-wall units, and packaged terminal AC units which care commonly used in hotel buildings. A split system locates the expansion coil and associated fan system inside a structure, and the compress coil on the outside of the structure, with refrigerant lines running between the two through the walls of the structure. Split systems can further be divided into ducted and non-ducted systems. In residences it is common to use a split, ducted AC system in which an air handler unit is located in a closet. The air handler includes the expansion coil and a fan to draw air in from the living area, and blow it over the chilled coil and into a duct system that distributes the chilled air to various rooms in the structure. The AC system achieves comfort (from heat) in two ways. First, obviously, the air is chilled, and heat energy removed from the air is transferred to the compressor unit outside the structure. But the second aspect of AC that many people fail to appreciate is that AC systems inherently dehumidify the air inside the structure as it chills the air. When moist air meets the chilled coil, moisture condenses into liquid water on the coil and is removed from the air. The condensate (water) is directed into drain channels and into a drain pan which is connected to a drain line that leads out of the structure and can be connected the sewer drain of the structure.

The cool, moist environment in an air handler closet unfortunately is a good environment for microbe growth. As a result, without determined maintenance, it is not uncommon for an air handler drain line to become clogged, resulting in water overflowing the drain pan or drainage system of the air handler. As a result, the water leaks into the structure, on the floor, to the walls, carpeting, etc. Water damage from overflowing air handlers is responsible for billions of dollars of damage to structures in the United States alone, as well as contributing to health issues (e.g. mold growth).

To prevent overflow problems, some manufacturers have installed float switches in the drainage system of their air handler units. The float switch uses a buoyant member to trip a switch in response to rising water level. If the drainage system is working normally, buoyant member remains at a lowered position. But if the drainage system becomes blocked, and water begins accumulating the drainage system, the buoyant member rises with the level of water being accumulates until it trips the switch. If/when the switch is tripped, it causes the air handler unit to shut off.

While a float switch can prevent overflow conditions, and thereby prevent water damage, they are susceptible to the same environment. That is, the growth that can cause blockage in the drain system can also interfere with the operation of the float switch. This can occur as a result of obstructing movement of the buoyant member, or corroding the circuitry/wiring of the float switch. Furthermore, it has been found that float switches are sometimes improperly installed. For example, the float switch can be miss-wired, or the drain pan is not installed level such that water drains out of a lower side of the drain pan without ever cause the float switch to trip.

Therefore, a need exists to overcome the problems with the prior art as discussed above.

SUMMARY OF THE INVENTION

In accordance with some embodiments of the inventive disclosure, there is provided an air handler condensate overflow shutoff system that includes an overflow conduit having a first end and a second end. The first end being coupled to a drainage system of an air handler to receive water from the drainage system when water from the air handler accumulates to a preselected level. The second end being positioned lower than the first end. The shut-off system further including an overflow container having an opening positioned under the second end of the overflow conduit, and a harness having a lower end and an upper end. The lower end being coupled to the overflow container, and the upper end operably coupled to a breaker throw of the air handler unit. The overflow container freely hangs on the lower end the harness, and the overflow container includes a lower volume portion that, when will filled with water, results in sufficient force being exerted on the breaker throw through the harness to cause the breaker throw to switch to an OFF position.

In accordance with a further feature, the overflow container further includes a upper volume portion in which water is accumulated after the breaker throw has been switched to the off position.

In accordance with a further feature, the lower volume portion includes a horizontal extension that extends horizontally relative to the upper volume portion.

In accordance with a further feature, the upper end of the harness is operably coupled to the breaker throw by a lever.

In accordance with a further feature, the lever extends outward from the breaker throw.

In accordance with a further feature, the lever is a double member, double action lever positioned along a front of the air handler and to a side of the breaker throw, the double action, double throw lever having at least two movable lever segments that are intercoupled including a first lever segment coupled to the upper end of the harness and an end segment coupled to the breaker throw.

In accordance with a further feature, the breaker throw is oriented vertically, the system further comprises at least one pulley mounted on the exterior housing of the air handler over which the harness passes to redirect a vertical force created by the overflow container into a horizontal force against the breaker throw.

In accordance with some embodiments of the inventive disclosure, there is provided an air conditioning system having a drain overflow shut-off that includes an air handler having an exterior housing and an exposed breaker. The exposed breaker having a breaker throw moveable from an ON position to an OFF position in response to a force applied to the breaker throw in a direction of movement of the breaker throw. The air handler further having a drainage system for draining condensate produced by a coil of the air handler. The system further includes an overflow conduit having a first end and a second end. The first end being coupled to the drainage system of an air handler to receive water from the drainage system when water from the air handler accumulates in the drainage system to a preselected level, and the second end being positioned lower than the first end. The system further includes an overflow container having an opening positioned under the second end of the overflow conduit, and a harness having a lower end and an upper end. The lower end being coupled to the overflow container, and the upper end being operably coupled to the breaker throw of the air handler. The overflow container is coupled to the lower end the harness, and when the overflow container receives a sufficient amount of water from the overflow conduit, a resulting force from a weight of the water is exerted on the breaker throw through the harness that causes the breaker throw to switch to the OFF position.

In accordance with a further feature, the harness is attached to the overflow container at a top of the overflow container at at least two points.

In accordance with a further feature, the overflow container includes a weight.

In accordance with a further feature, the upper end of the harness is operably coupled to the breaker throw by a lever.

In accordance with a further feature, the lever extends outward from the breaker throw.

In accordance with a further feature, the lever is a double member, double action lever positioned along a front of the air handler and to a side of the breaker throw, the double action, double throw lever having at least two movable lever segments that are intercoupled including a first lever segment coupled to the upper end of the harness and an end segment coupled to the breaker throw.

In accordance with a further feature, the breaker throw is oriented vertically, the system further comprises at least one pulley mounted on the exterior housing of the air handler over which the harness passes to redirect a vertical force created by the overflow container into a horizontal force against the breaker throw.

In accordance with a further feature, the overflow container further includes a upper volume portion in which water is accumulated after the breaker throw has been switched to the off position.

In accordance with a further feature, the lower volume portion includes a horizontal extension that extends horizontally relative to the upper volume portion.

In accordance with some embodiments of the inventive disclosure, there is provided a method of shutting off an air conditioner system that includes coupling an overflow conduit, having a first end and a second end, to an air handler unit of the air conditioner system. The first end being coupled to a drainage system of the air handler unit to receive water from the drainage system when water from the air handler unit accumulates to a preselected level, and the second end being positioned lower than the first end. The method further includes mounting an overflow container under the second end of the overflow conduit such that an opening of the overflow container is positioned under the second end of the overflow conduit. The method further includes coupling a lower end of a harness to the overflow container, and operably coupling an upper end of the harness to a breaker throw of an electrical circuit breaker of the air conditioner system that is positioned at a front panel of the air handler unit. The method further includes accumulating water in the overflow container from the drainage system of the air handler to a mass sufficient to create a force on the breaker throw, through the harness, to cause the breaker throw to switch to an OFF position.

In accordance with a further feature, the air handler unit includes a float switch, coupling the first end of the overflow conduit to the drainage system of the air handler unit comprises coupling the first end of the overflow conduit at a level such that water only flows into the first end of the overflow conduit when a water level in the drainage system is above a level necessary to trip the float switch.

In accordance with a further feature, operably coupling the upper end of the harness to the breaker throw comprises coupling the upper end of the harness to a lever that is operably coupled to the breaker throw.

In accordance with a further feature, operably coupling the upper end of the harness to the breaker throw comprises providing a pulley on the air handler unit and routing the upper end of the harness over the pulley to the breaker throw.

Although the invention is illustrated and described herein as embodied in an air conditioner shut-off system that responds in the event of the drainage system of the air handler of the air conditioner system becoming obstructed, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the member being described or discussed. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
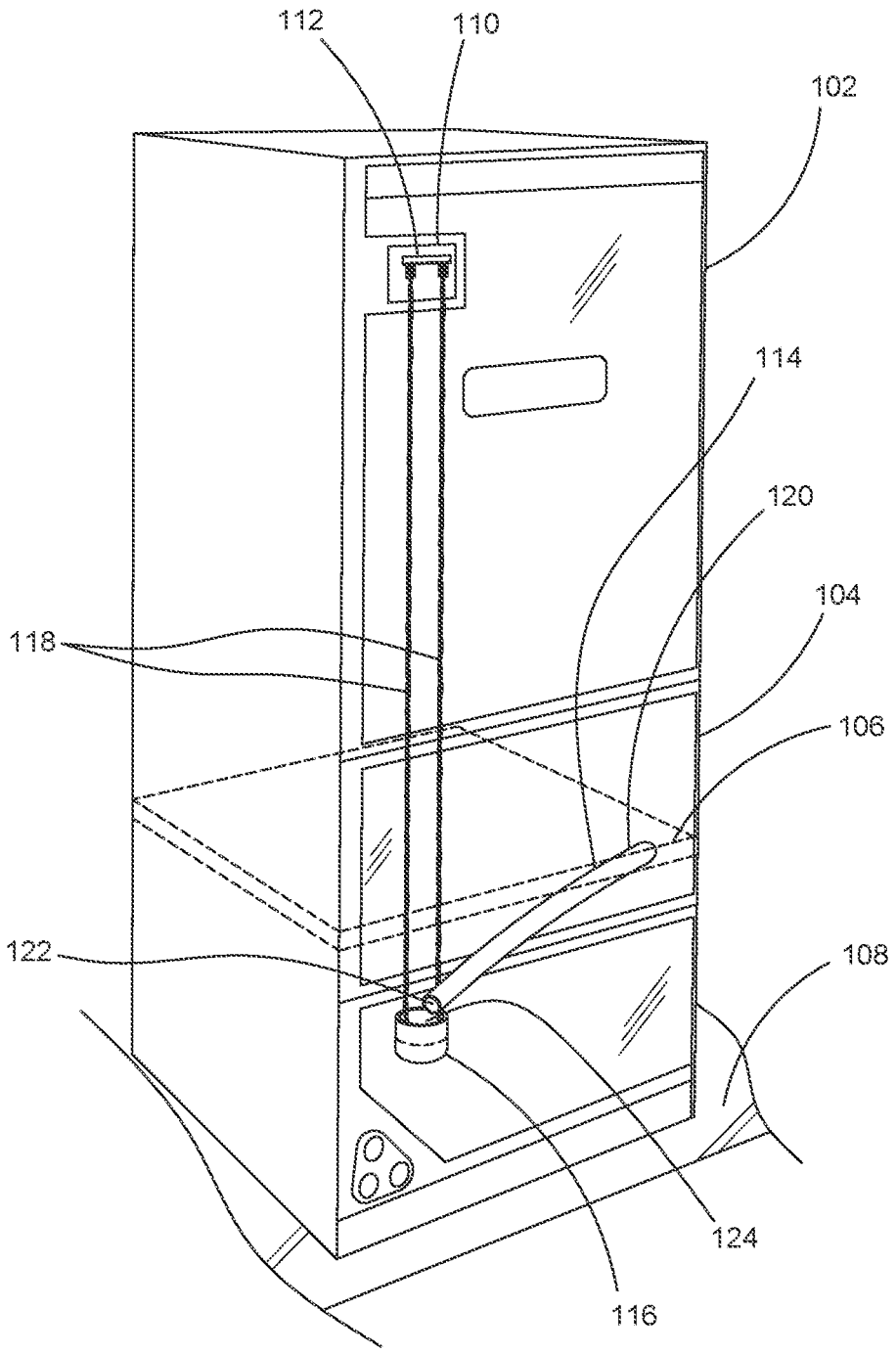
FIG. 1 shows an air handler unit of an air conditioning system having an overflow shutoff system, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

FIG. 1 shows an air handler unit 100 of an air conditioning system having an overflow shutoff system, in accordance with some embodiments. Specifically what is shown is the front of an air handler unit as one would see it in a closet of a structure. The components of the air handler unit are typically disposed within a sheet metal enclosure, the outside of which is seen here, as it would appear from the front. Air handler units are commonly located in a closet of a habitation structure (house, apartment, office, etc.), and connected to ductwork that distributes air chilled and blown by the air handler to other parts/rooms of the structure. The air handler unit is also coupled, electrically and through fluid channels, to a compressor unit that is located outside of the structure. Further, the air handler unit and the compressor unit are controlled by a controller such as a thermostat, as is well known, which senses the ambient temperature inside the structure and determines when to turn on and turn off the air conditioner components (air handler unit and compressor unit) relative to a user-selected temperature setting.

The air handler unit 100 can include an upper portion 102 and a lower portion 104 that rest on or over a floor 108. The upper portion 102 can include the expansion coil through which chilled refrigerant is passed to chill the coils. A fan in the lower portion 104 blows air through the expansion coils, thereby chilling the air, and into the ductwork of the structure. As ambient air drawn in by the fan from the interior of the structure is blown over/through the chilled expansion coil, humidity in the air condenses on the expansion coil. This water is directed into a drainage system that leads out of the structure and can be connected to the other plumbed drainage of the structure. The drainage system includes collection pans that are attached to drain tubing. The precise arrangement of the drainage system is not material, but it is common for the air handler drainage system include a drain or catch pan 106 under the expansion coil to both collect water directed from the coil into the drainage system as well as water that drips from the coil, as may occur when the fan shuts off. The drainage system is gravity based, and the drain pan 106 is the lowest portion of the drainage system in which water accumulates, and it is connected to a drain tube that leads downward into the drain plumbing of the structure (or a suitable equivalent out of the building). Furthermore, when the air condition system is working improperly, such as with too low a level of refrigerant, the expansion coil can accumulate ice, and the catch pan and drainage system are typically designed to anticipate such conditions and handle the resulting water volume.

In addition, it is common to locate a master circuit breaker 110 on the front of the air handler unit. The circuit breaker 110 is a circuit interrupting switch that allows electrical current to flow into the air conditioner system, or at least the air handler unit 100, to a certain level. If more current than that level is drawn through the circuit breaker 110, it is assumed to be the result of an electrical fault, and will cause the circuit breaker to switch from closed to open circuit, thereby depriving the air conditioner system of any further electrical power. The circuit breaker 110 can be operated manually as well by moving a breaker throw 112. The breaker throw 112 provides small handle that can be used to throw or reset the circuit breaker 110. Thus, if the circuit break spontaneously trips and opens, then repairs can be made and the circuit breaker can be reset. If repairs or maintenance need to be made while the air handler is operational, then the circuit breaker 110 can be manually thrown by a person to prevent the risk of electric shock/electrocution while working on the air handler, and thereafter the circuit breaker can be reset. It is common for the circuit breaker 110 to be oriented such that when the circuit breaker 110 is allowing electric current to flow the breaker throw 112 is in an "up" position. The breaker throw 112 typically comprises a horizontally oriented bar member coupled to the breaker switch mechanism. When the breaker is thrown manually or tripped by excess current, the breaker throw is moved (manually, or as a result of tripping) from the "up" position to a "down" position. In the "down" position the breaker throw in in a position that is vertically below where it is in the "up" position. The overflow conduit 114 is a guide for water and can be a tube or pipe. The first end 120 of the overflow conduit 114 is connected to the drainage system of the air handler, such as at the drain pan 106 (shown here in broken line to indicate it is inside the lower portion 104).

The shutoff system includes an overflow conduit 114 that has a first end 120 and a second end 122 that is positioned lower than the first end 120, and over an opening 124 of an overflow container 116. At the first end 120, the overflow conduit 114 is positioned such that water will exit the drain pan 106 before the water level in the drain pan 106 is able to overflow the sides of the drain pan 106. In systems that have a float switch shutoff, the level of water in the drain pan 106 at which water begins exiting the drain pain 106 into the overflow conduit is above a level that would cause the float switch to trip in order to allow the float switch to act as the primary means of stopping the air handler if the drain becomes obstructed.

When water begins passing through the overflow conduit 114 from the drain pan 106 it is directed into the overflow container 116. The overflow container 116 is coupled to the breaker throw 112 through a harness 118, wherein the upper end of the harness 118 is coupled to the breaker throw 112 and the lower end of the harness 118 is coupled to the overflow container 116. The harness can be one or more strings, wires, or equivalent components tying the overflow container 116 to the breaker throw 112. The breaker throw 112 can be modified to include one or more attachment points for the harness 118. As water accumulates in the overflow container 116, a downward force is exerted on the breaker throw 112 through the harness 118. When a sufficient volume of water is accumulated, the force of the weight of the water will pull the breaker throw 112 down, opening the breaker circuit and shutting off the air handler unit 100 and/or the air conditioner system in total. Thus, the volume of the overflow container 116 must be large enough to collect a mass of water sufficient to produce a weight that can pull the breaker throw 112 down. Further, since water will continue to drain out of the air handler, the overflow container should have additional volume to continue collecting water and prevent spillage due to overflow.

Figure 2:
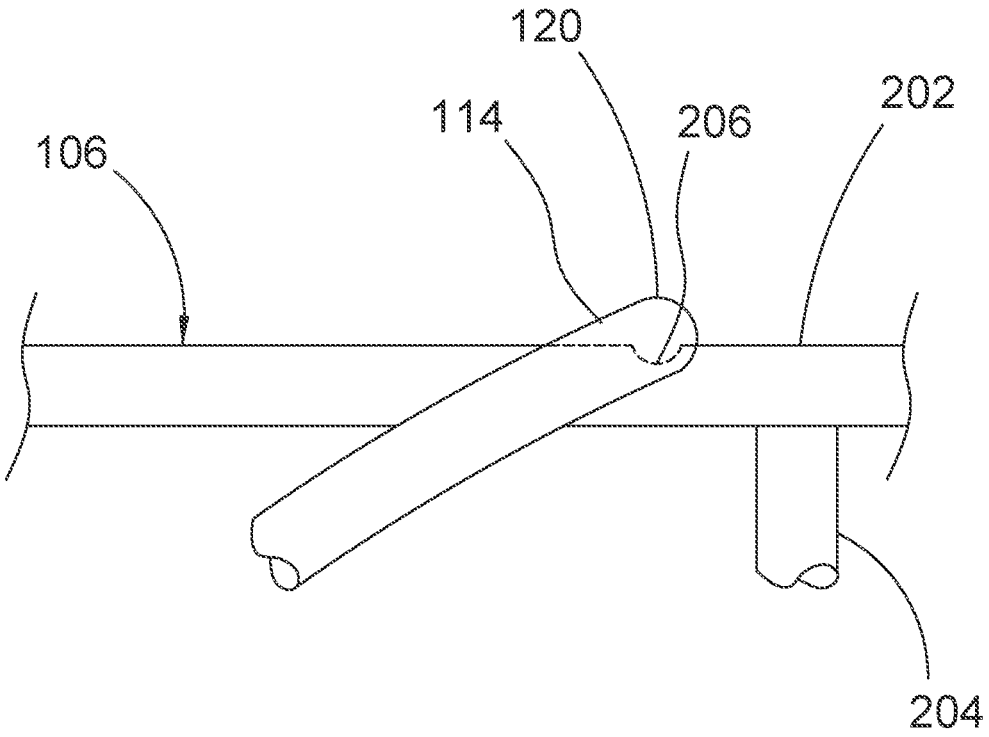
FIG. 2 shows a detail view of an overflow conduit attached to a side drain pan of an air handler, in accordance with some embodiments.

FIG. 2 shows a detail view of an overflow conduit 114 attached to a side 202 of a drain pan 106 of an air handler, in accordance with some embodiments. The side 202 can have a lowered portion 206 through which water will flow, and the first end 120 of the overflow conduit is attached at that point with a watertight seal between the first end 120 of the overflow conduit 114 and the side 202 of the drain pan. The lowered portion 206 can be an opening or notch formed in the side 202 of the drain pan 106 at or adjacent to a top edge of the side 202. Normally, water that is directed into the drain pan 106 will exit the drain pan 106 through a drain tube 204 coupled to the bottom of the drain pan 106 or at a position lower on the side 202 of the drain pan 106 than the first end 120 of the overflow conduit 114. If the drain tube 204 becomes obstructed, however, water will accumulate in the drain pan 106 to the level of the lowered portion 206 and flow into the 120 overflow conduit 114 and through overflow conduit 114 and out the second end of the overflow conduit 114 into the overflow container (e.g. 116).

Figure 3:
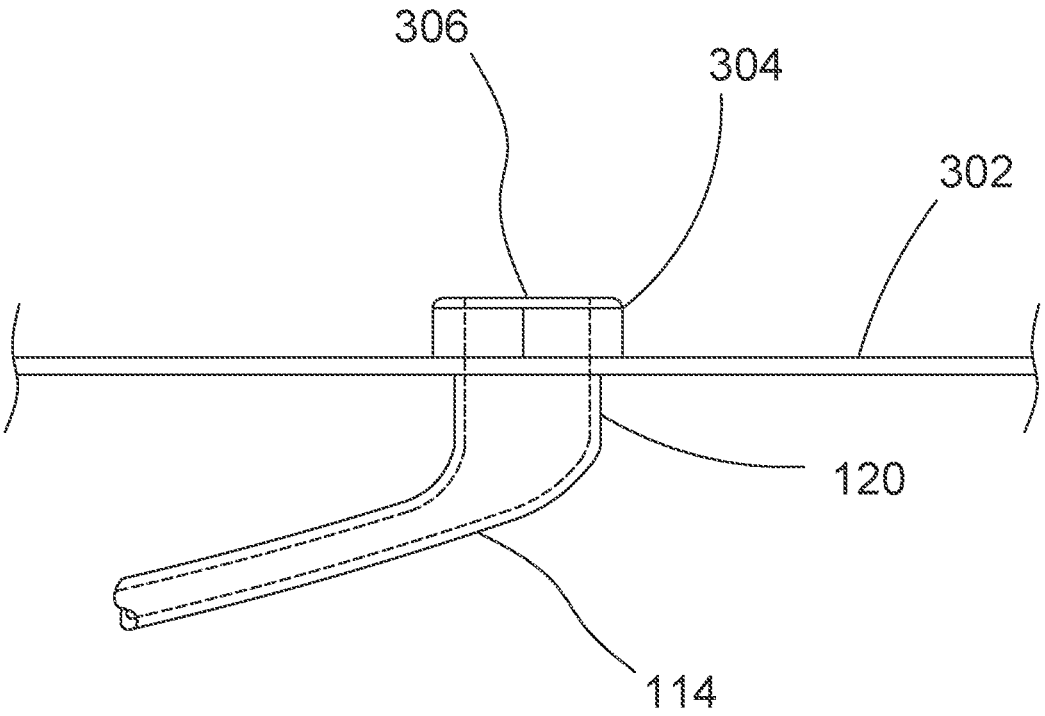
FIG. 3 shows a detail view of an overflow conduit attached to a drain column through the floor of a drain pan of an air handler, in accordance with some embodiments.

FIG. 3 shows a detail view of an overflow conduit 114 attached to a drain column 304 through the floor 302 of a drain pan of an air handler, in accordance with some embodiments. The drain column 304 has an opening 306 at its top such that when the water level over the floor 302 of the drain pan exceeds the height of the drain column it will flow into the opening 306 and into the overflow conduit 114. The drain column 304 passes through the floor 302 to mate at a lower end with the first end 120 of the overflow conduit 114. The height of the drain column 304 can be selected to be below a height of the side of the drain pan, but higher than a level of water needed to trip a float switch of the air handler.

Figure 4:
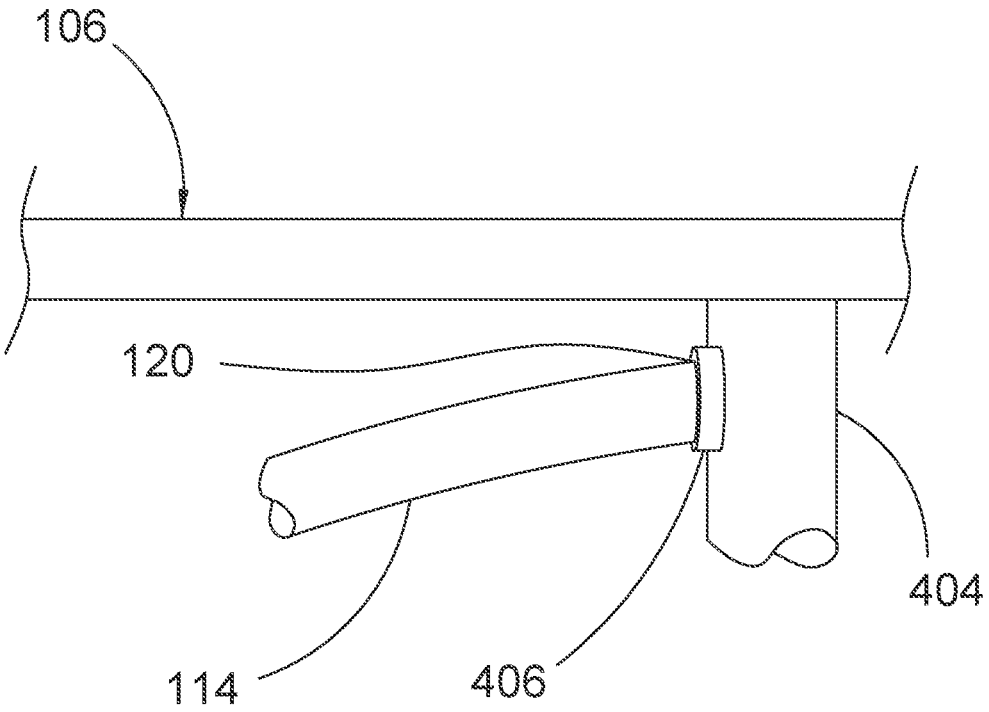
FIG. 4 shows an overflow conduit attached to a drain tube of an air handler drainage system, in accordance with some embodiments.

FIG. 4 shows an overflow conduit 114 attached to a drain tube of an air handler drainage system, in accordance with some embodiments. In this example the overflow conduit is 114 is attached directly to the drain tube 404 that drains water from the drain pan 106 through a side fitting 406. If there is an obstruction in the drain tube 404, then water flows into the overflow conduit 114 without water accumulating in the drain pan 106.

Figure 5:
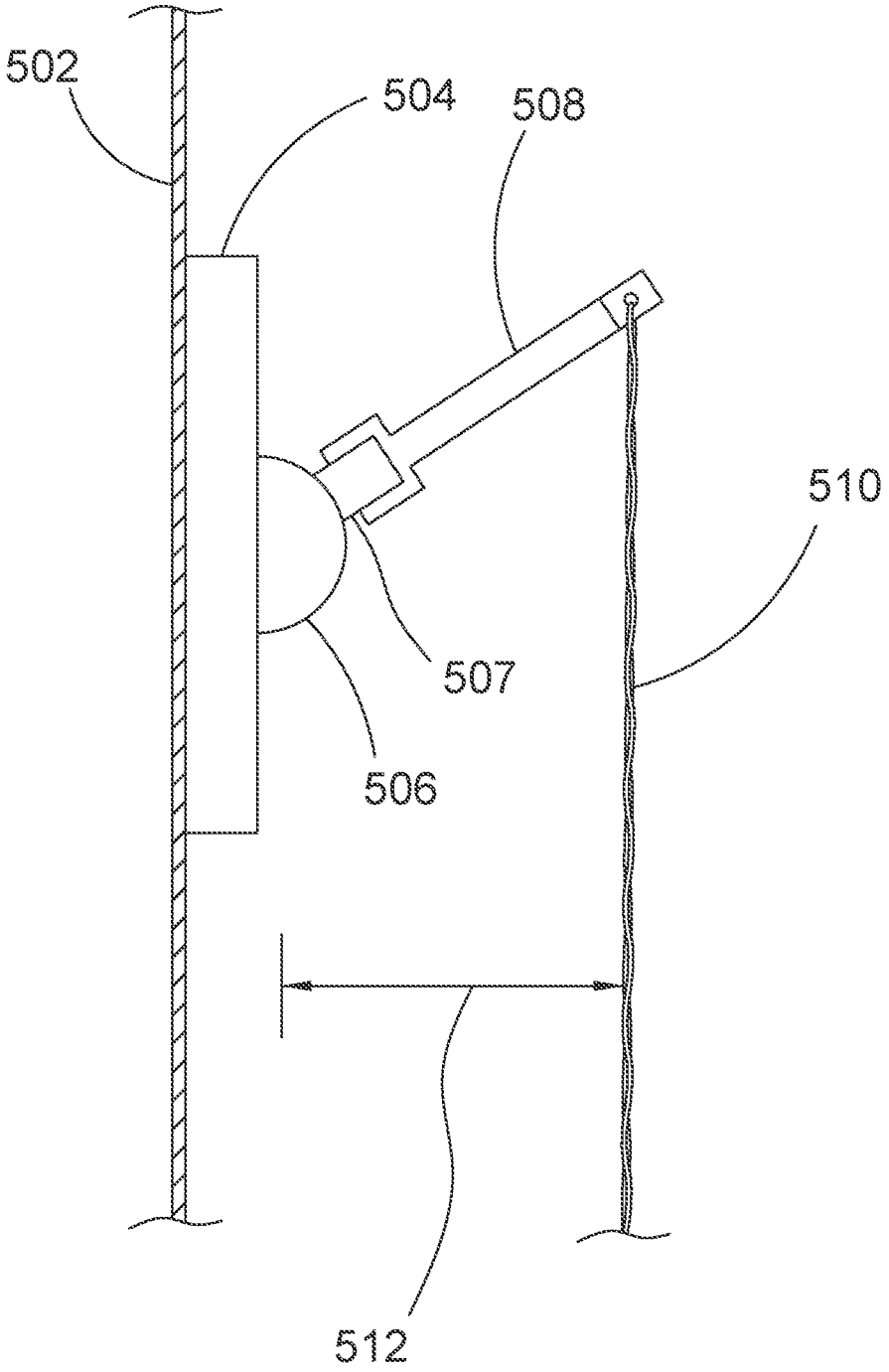
FIG. 5 shows a side view of a front of an air handler, showing a breaker having a breaker throw to which a lever is attached to provide a mechanical advantage for throwing the breaker by an overflow container, in accordance with some embodiments.

FIG. 5 shows a side view of a front of an air handler, showing a breaker having a breaker throw to which a lever is attached to provide a mechanical advantage for throwing the breaker by an overflow container, in accordance with some embodiments. The front sheet metal cover 502 of the air handler unit exposes or has mounted a breaker housing 504. The breaker housing includes a breaker throw 506 having a breaker throw handle 507. The breaker throw handle 507 can be a bar-like member configured to allow a person to place a finger or object against the handle 507 to move the throw 506. In the embodiments according to FIG. 1, the upper end of the harness 118 can be attached directly to the handle 507. However it is contemplated that, given the force needed to move the handle 507 and throw 506 from an on to an off position, a large volume of water may have to be accumulated in the overflow container to have enough mass to move the throw 506. To reduce the amount of force needed to throw the breaker, and hence the amount of water needed to be accumulated in the overflow container, it is contemplated that some mechanical advantage can be employed by adding a lever arm 508 that is connected at one end to the handle 507 and at the other end to the upper end 510 of the harness. The length of the lever dictates a displacement 512 of the force acting on the breaker throw 506.

Figure 6A:
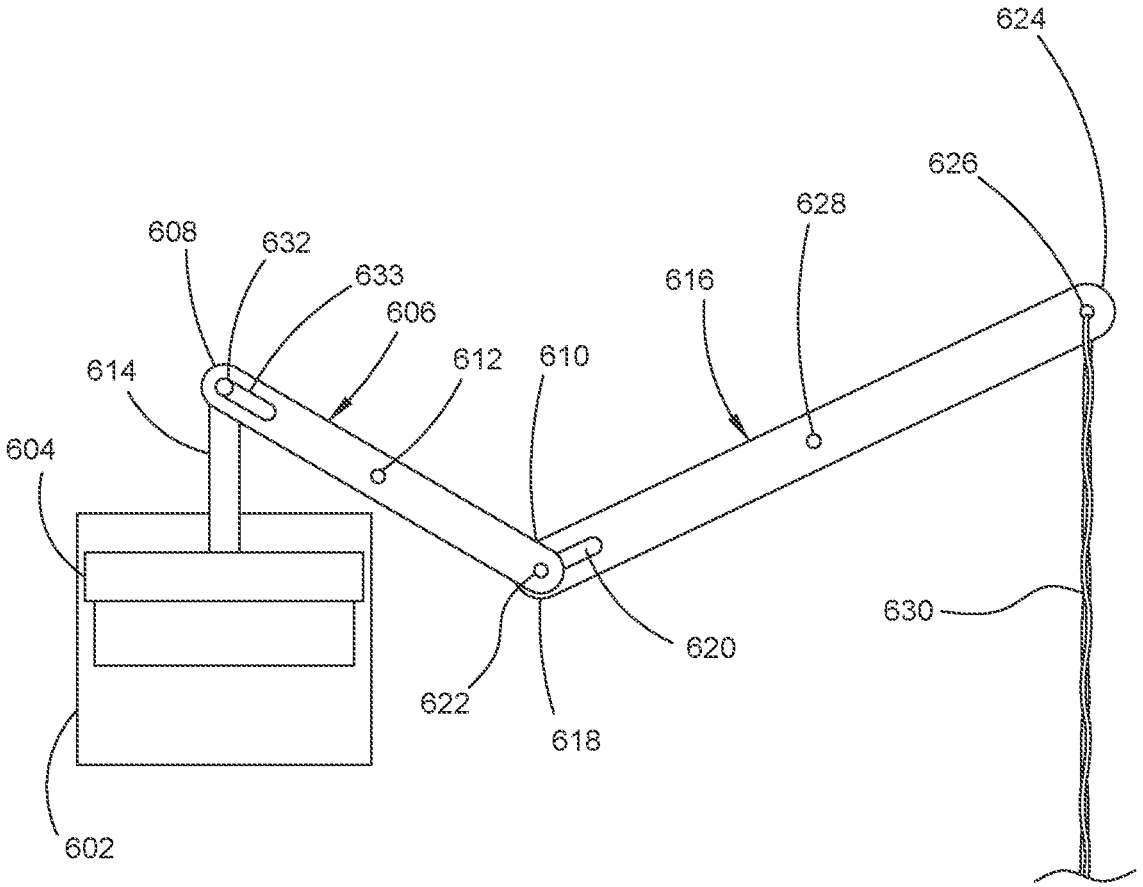
FIG. 6A shows a multi-segment lever arrangement that is arranged along the front of an air handler for operating a breaker in response to an overflow condition, in a normal state, in accordance with some embodiments.
Figure 6B:
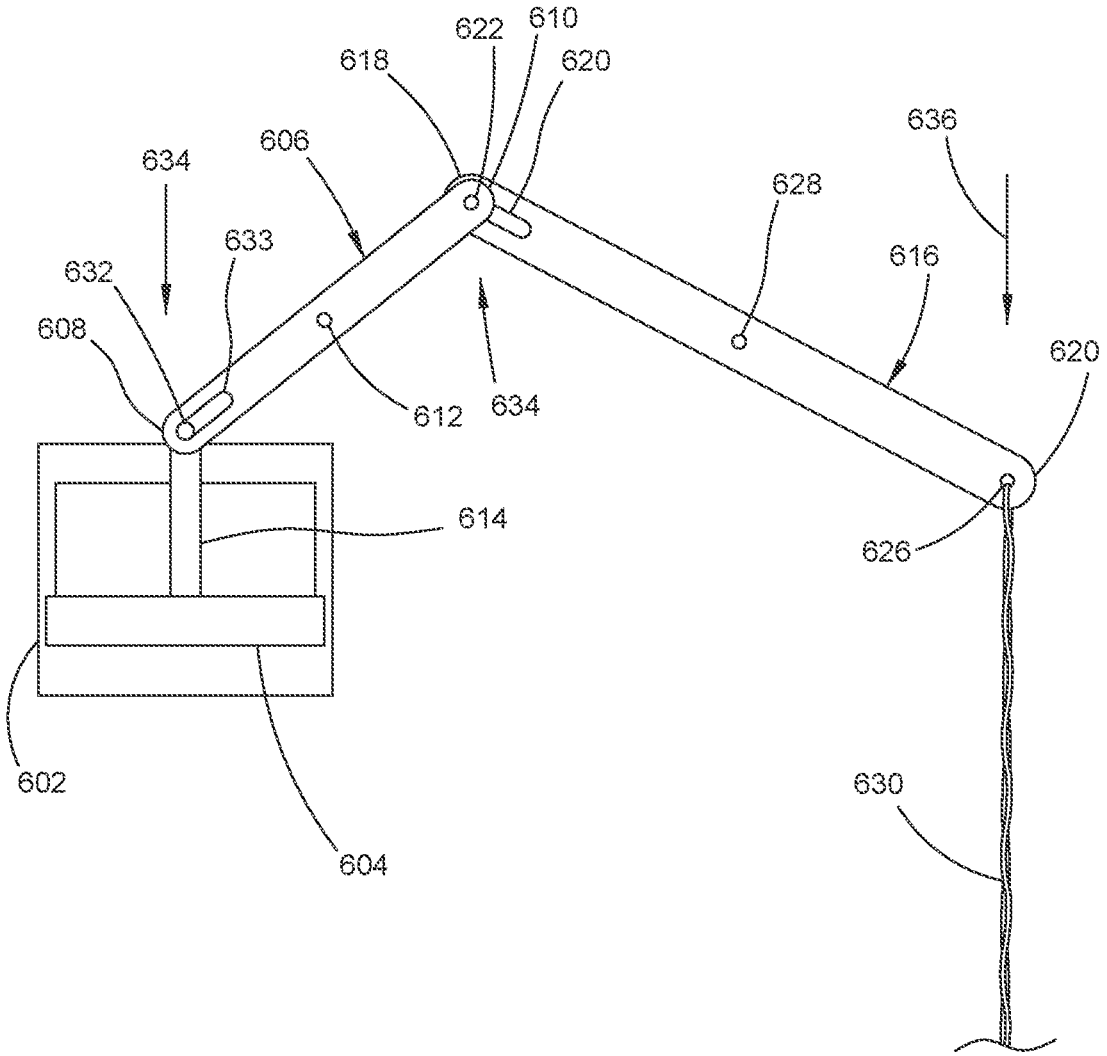
FIG. 6B shows the multi-segment lever arrangement upon tripping the breaker, in accordance with some embodiments.

FIGS. 6A and 6B show a multi-segment lever arrangement that is arranged along the front of an air handler for operating a breaker in response to an overflow condition. FIG. 6A shows the multi-segment lever arrangement, in a normal state (e.g. breaker not thrown open), and FIG. 6B shows the multi-segment lever arrangement upon tripping the breaker. The multi-segment lever arrangement can be used to provide a mechanical advantage on an air handler unit were there is insufficient space between the front of the air handler unit and a door of the closet in which the air hander unit is located to allow a lever such as that shown in FIG. 5.

In general there is a breaker housing 602 that has a breaker throw 604 (including a handle). The multi-segment lever arrangement includes at least two segments including a short segment 606 and a long segment 616. The particular lengths of the short and long segments 606, 616 can be selected based on the particular application, and considering how much force is needed to throw the breaker, and how much (or how little) water is desired to be accumulated in the overflow container. The segments 606, 616, rather than extending forward of the front of the air handler unit, and be positioned along the front of the air handler unit, needed no more front clearance than the breaker throw 604.

Both of the lever segments 606, 616 are attached to the front of the air handler unit at a generally central position in a manner that allows each segment 606, 616 to pivot about the attachment point in a plane parallel to the front of the air handler unit. Thus, segment 606 is attached to pivot mount 612 and segment 616 is attached to pivot mount 628. The pivot mounts are fixed to the sheet metal of the front cover of the air handler unit, and allow the segments 606, 616 to pivot about them, spaced slightly away from the front of the air handler (e.g. by about half to one inch, +1-50%). Segment 606 is attached at a first end 608 to a standoff 614 that is further coupled to the throw 604 by a pivot 632 in a slot 633. The other end 610 of segment 606 is coupled to an end 618 of segment 616 by a pivot extension 622 that extend into a slot 620 in the end 618 of segment 620. The slot 620 provides relief for the pivot extension 622 as the lever segments 606, 616 pivot about their respective pivot mounts 612, 628. The other end 624 of segment 616 has an attachment point 626 to which the upper end 630 of the harness (e.g. harness 118) is attached.

In FIG. 6A the breaker throw 604 is in the "up" position, and the circuit is closed, allowing electric current to flow through the breaker circuit in the breaker housing 602. The harness is attached to the overflow container, and as water accumulates in the overflow container, the force exerted at the end 624 of segment 616 increases. This force is communicated through segment 616 to segment 606 through the coupling of pivot extension 622 and slot 620, and in turn through segment 606 to the standoff 614 and to the breaker throw 606, which resists the force, to a point, at which time the breaker throw 604 changes to the "down" position as shown in FIG. 6B. At the same time, end 608 of segment 606 follows the breaker throw 604 as indicated by arrow 634, and coupling point of the two segments moves in the opposite direction as indicated by arrow 634, and the end 624 of segment 616 at which the harness is attached follows the force being exerted on it by the weight of the water accumulated in the overflow container as indicated by arrow 636.

Figure 7:
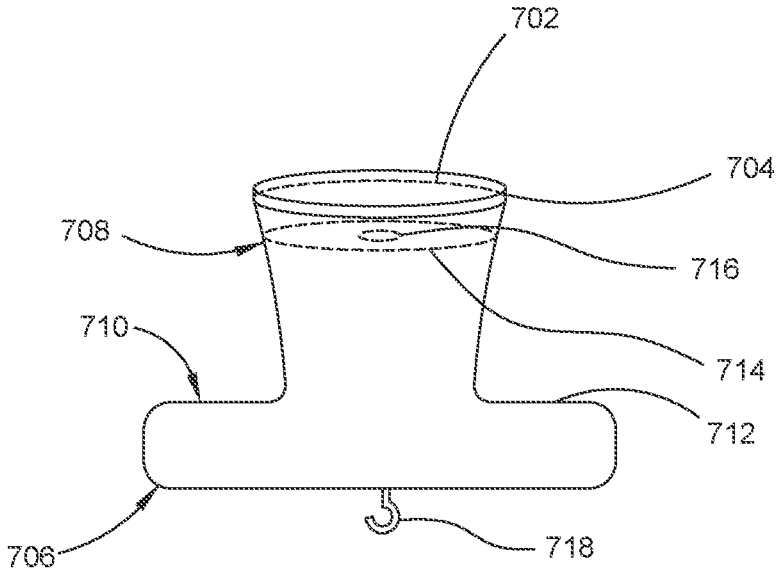
FIG. 7 shows an example of an overflow container for an overflow shutoff system, in accordance with some embodiments.

FIG. 7 shows an example of an overflow container 700 for an overflow shutoff system, in accordance with some embodiments. While virtually any shape of container that can accumulate a sufficient volume of water can be used in the inventive shutoff system, it is contemplated that some consideration of the shape and function of the overflow container can improve the shutoff system over essentially a bucket. Overflow container 700 has an opening 702 at the top 704 of the container through which water can be received from the overflow conduit. The harness can be connected at the top 704 at two or more locations. If there are only two locations where the harness is connected to the top 704 then the connection points can be on opposite sides of the top. Two or more connection points reduces the likelihood of the overflow container to spin or twist. Conversely, the harness can be configured to have only one connection point at the other end of the harness since the breaker throw, or interstitial components (e.g. levers, pulleys) will not twist out of position.

Water will first fill a lower volume portion 706 that can incudes horizontal extensions 710, 712 that extend out horizontally relative to an upper volume portion 708. The horizontal extensions 710, 712 allow a mass of water to accumulate in a horizontal direction, rather than requiring a taller, narrower container. Thus, container 700 is useful when there is limited distance between the point at which the first end (e.g. 120) of the overflow conduit 114 attaches to the drainage system of the air handler unit 100 and the floor 108. It is further contemplated that, to reduce the chance of spillage of water accumulated in the container 700, a upper floor 714 having a central opening 716 can be disposed near the top 704 of the container 700. Water falling into the opening 702 can fall on the upper floor 714 and flow through the opening 716 into the lower volume portion 706. Thus, if the container is tilted, water that has accumulated in the container 700 is less likely to spill out as it will be substantially blocked by the floor 714. The lower volume portion can be sized to collect enough water mass to throw the breaker (through the harness). However, even though throwing the breaker will shut off electric power to the air handler unit, water will continue to drain from the expansion coil. Thus, the upper volume portion 708 is intended to continue to accumulate water after the air handler unit has been shut off. It is further contemplated that a given breaker may require an unusually high breakover force to switch the breaker, and to account for that a hook 718 can be used to add a dry weight to the container 700. Alternatively weights could be equivalently hung on other portions of the container 700 or simply added to the container so that only a small amount of water is necessary to add to the weight already in the overflow container 700.

FIGS. 8A-8D show a side view of a drainage pan for an air handler unit that includes a float switch. A float switch can be used at the primary means of dealing with a drain obstruction, and recognizes that a drain does not typically go from being fully open to fully obstructed. Rather, it is more typical that an obstruction grows over time and reduces the rate at which water can drain out of the system. A float switch can be configured and connected to the air handler controller, or thermostat, such that if the float switch is tripped, it is tripped well before water begins to overflow the drain pan, and it allows the air handler to be shut down "softly" so as not to risk damage to components of the air conditioner system. Once a float switch is tripped, a maintenance alarm can activated to alert an appropriate entity that maintenance is required. The float switch can operate with hysteresis such that as the water level diminishes to a sufficient level, the switch can be reset, allowing the air conditioner to operate again. This can be useful in situations where, again, a hard shutdown is not desired, such as when a resident goes is out of the house for several days (e.g. weekend vacation) and there are items in the residence that may be damaged by excessive heat that can occur over prolonged period without air conditioning. It will be appreciated by those familiar with the variety of air handler designs that, in addition to the in-pan float switch described and shown here, other configurations and locations of float switches exist and are in common use. For example, it is known to locate a float switch in a vertical drain tube. The operation and function of all float switches, however, are substantially equivalent; when the drainage line becomes obstructed and water backs up in the drain line, a buoyant member rises with the rising water level to trip a switch mechanism.

Figure 8A:
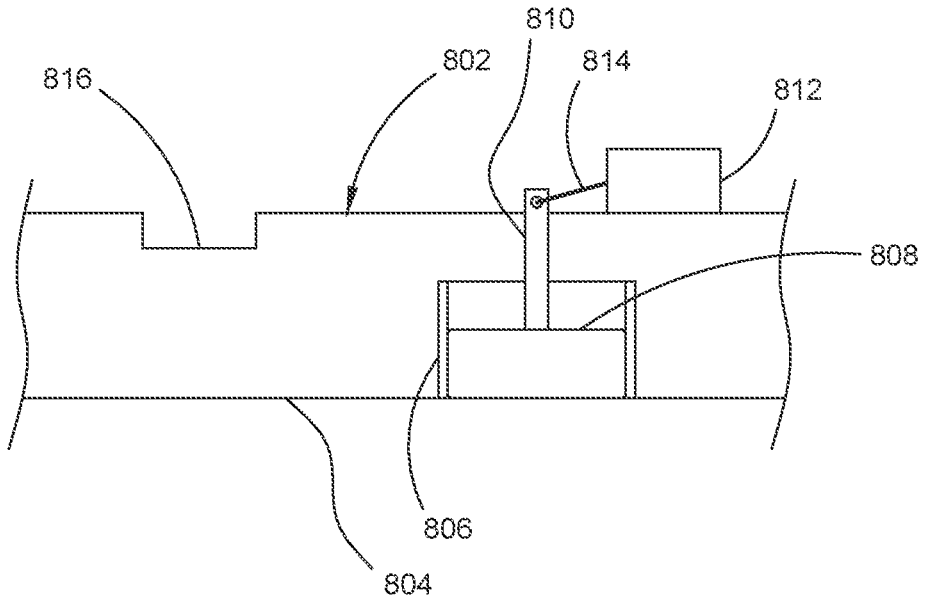
FIG. 8A shows a side view of drainage pan having a float switch shutoff in a normal state.
Figure 8B:
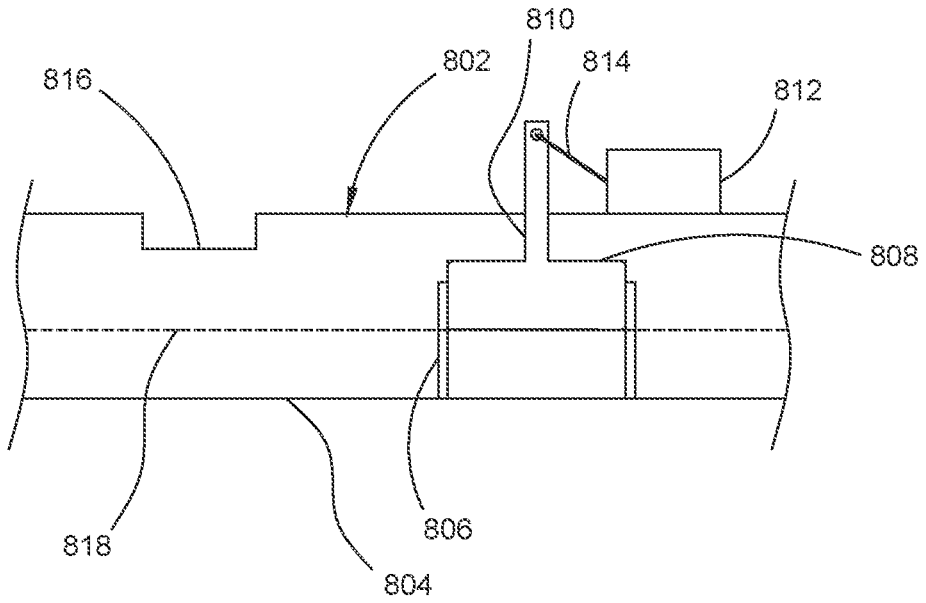
FIG. 8B shows a side view of drainage pan having a float switch shutoff in a switched state.

FIG. 8A shows the float switch shutoff in a normal state, un-tripped. A drain pan includes a sidewall 802 and a floor 804. The sidewall 82 surrounds the floor 804 to define a volume in which water can accumulate. The drain pan is coupled to a drain tube (not shown here), as in FIGS. 2 & 4. The float switch includes a buoyant member 808 that can be contained within a boundary wall 806 that is open at some portion to the floor 804. Thus, if water begins accumulating over the floor 804, it will cause the buoyant member 808 to rise, bounded by the wall 806. The buoyant member 808 is attached to a standoff 810 that is connected to a switch lever 814 which operates a switch 812. In FIG. 8A there is no water present, so the buoyant member 808 is sitting on the floor 804, and the switch lever 814 is lowered, and as a result the switch 812 is in an operating switch state, meaning the air handler is allowed to operate. If, however, the drain tube becomes obstructed, then water can accumulate over the floor 804. In FIG. 8B, the buoyant member rises with the accumulating water level to level 818, and eventually the switch lever 814 rises in correspondence sufficient to trip the switch 812 and trigger a soft shutdown of the air handler, as well as a maintenance alarm.

Figure 8C:
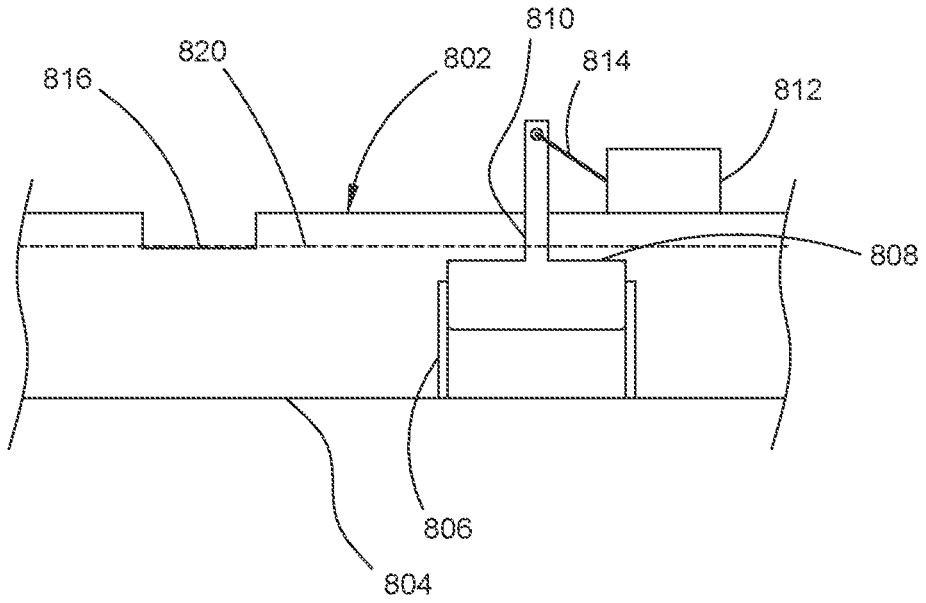
FIG. 8C shows a side view of drainage pan having a float switch shutoff in a first fault state, causing water to flow into and overflow shutoff system, in accordance with some embodiments.
Figure 8D:
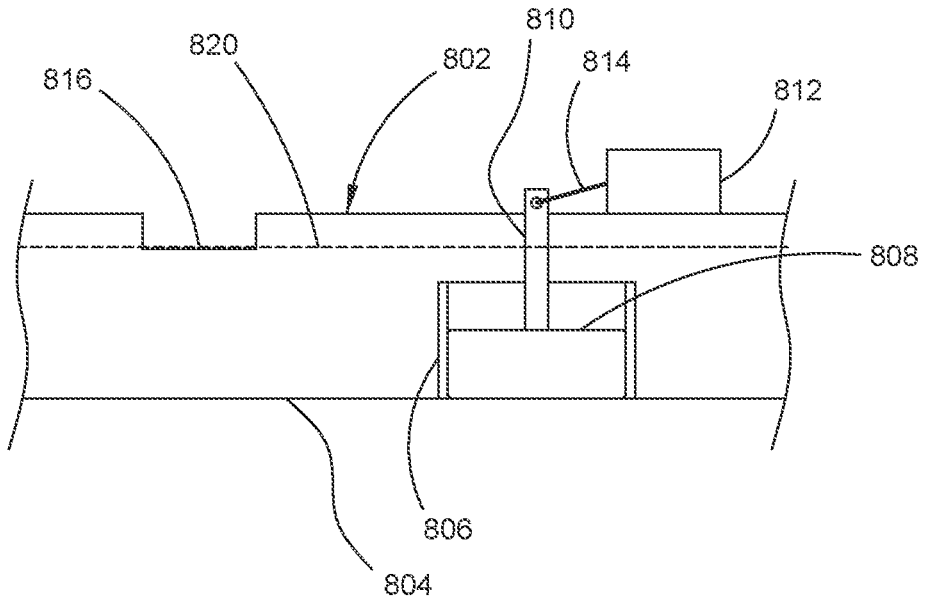
FIG. 8D shows a side view of drainage pan having a float switch shutoff in a second fault state, causing water to flow into and overflow shutoff system, in accordance with some embodiments.

FIGS. 8A-8B illustrate the normal operation of a float switch. However, in FIGS. 8C-8D, the float switch has failed. FIG. 8C illustrates a condition where the buoyant member freely rises, but either the switch 812 has failed, or some wiring fault or other electrical fault has occurred the neutralizes the float switch. As a result, water will continue rising above level 818 to level 820, which is at the level of lowered portion 816 of the drain pan sidewall 802, and where the overflow conduit is connected. As a result, water will flow through the overflow conduit, into the overflow container, and eventually trip the breaker as described hereinabove. A similar condition occurs in FIG. 8D, but instead of the electrical components failing (or being improperly wired), the buoyant member 808 has become stuck due to the same type of condition that has led to the obstruction. This can occur because the floor 804 of the drain pan is often, if not constantly wet, depending on the locale and season. Thus, the switch 812 is never switched because the buoyant member never rises with the water level. This the water level will rise to level 820 (which is above level 818), and result in the breaker being switched by the overflow container filling with water and exerting force on the breaker throw.

Figure 9:
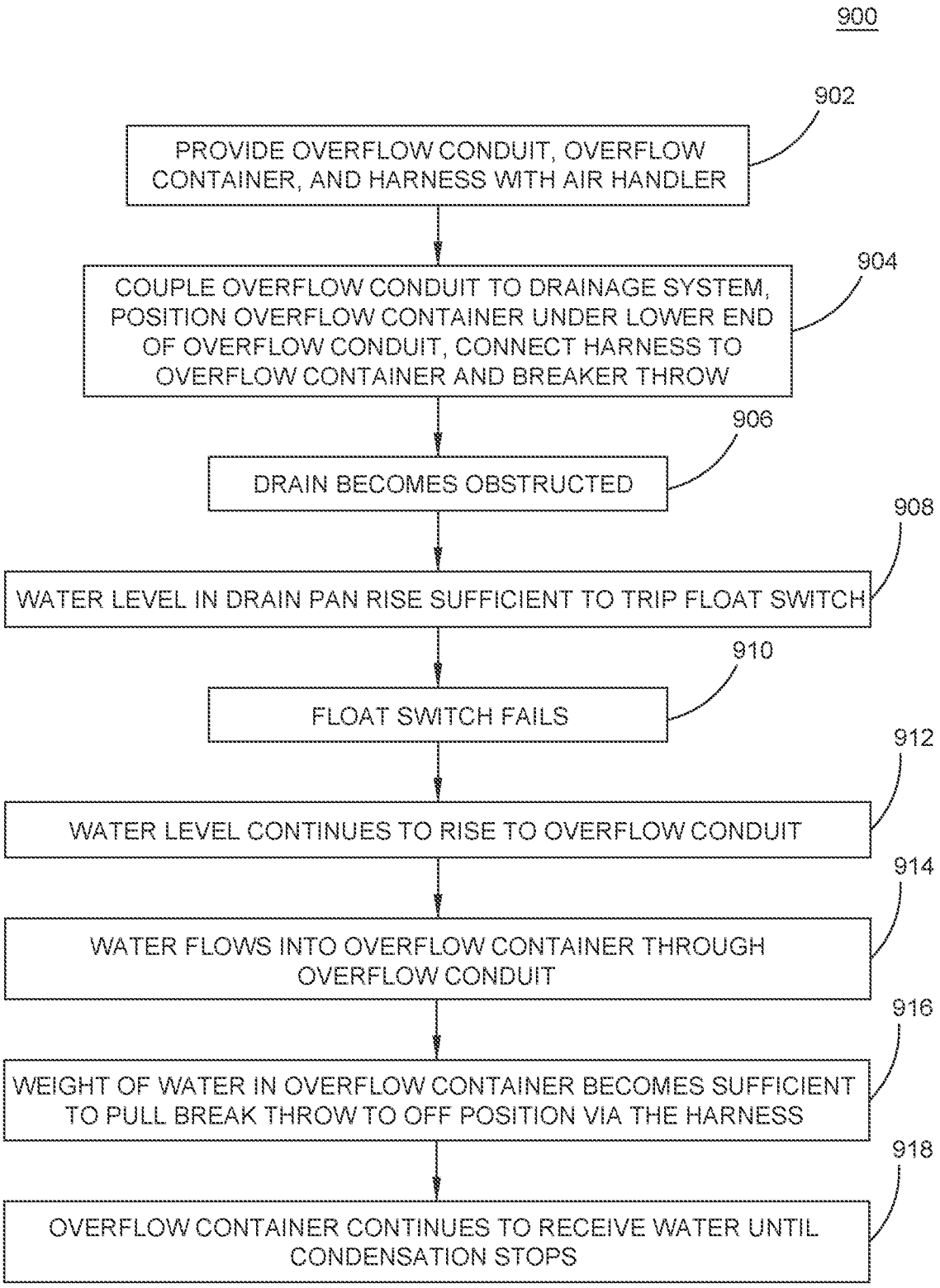
FIG. 9 shows a flow chart diagram of a method of operating an overflow shutoff system for shutting of an air conditioner system in response to an obstructed drain, in accordance with some embodiments.

FIG. 9 shows a flow chart diagram of a method 900 of operating an overflow shutoff system for shutting of an air conditioner system in response to an obstructed drain, in accordance with some embodiments. In step 902 the overflow conduit, overflow container and harness are provided with an air handler unit. In step 904 the overflow conduit, overflow container, and harness are mounted on the air handler unit, and the lower end of the overflow conduit is positioned over the opening of the overflow container. The harness is operably coupled to the breaker throw, either directly or via some mechanical advantage assembly. In either step 902 or 904, the force needed to cause the breaker throw to move can be tested, and a suitable amount of weight can be added to the overflow container so that less water is needed to flow into the overflow container and cause the breaker throw to switch. Thereafter the air conditioner system is operated normally. In step 906 the drain becomes obstructed, and in step 908 water in the drain pan accumulates to a level sufficient to trip a float switch. If the float switch is inoperable, or not present, then the method 900 proceeds through step 910 to step 912 where the water level in the drain pan accumulates to a level sufficient to flow into the overflow conduit in step 914. In step 916 water accumulates in the overflow container and eventually produces a weight sufficient to switch the breaker throw through the harness and shut off electricity to the air handler. Then in step 918 water can continue to accumulate in the overflow container until the air handler coil stop producing condensate. At the point the air hander and air conditioner system are shut off, the water remains contained, and no water damage occurs to the structure.

Figure 10:
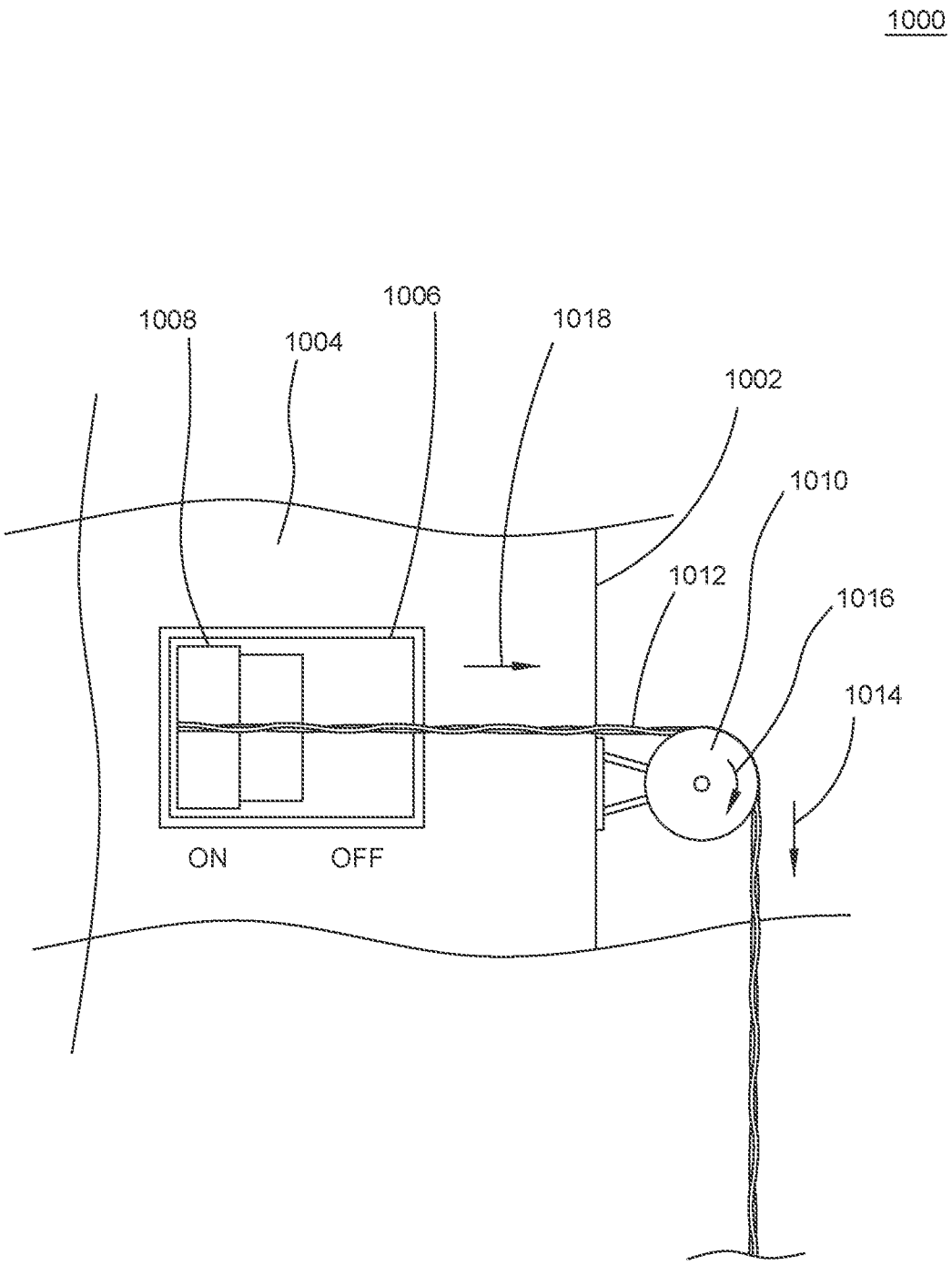
FIG. 10 shows a side view of an air handler unit having a breaker on the side of the unit, with a harness attached to the breaker throw, in accordance with some embodiments.

FIG. 10 shows a side view of an air handler unit 1000 having a breaker 1006 on the side 1004 of the unit, with a harness 1012 attached to the breaker throw 1008, in accordance with some embodiments. More relevantly, the breaker throw 1008 is arranged in a vertical orientation. Thus, directly connecting the harness 1012 between the breaker throw 1008 and the overflow container (not shown here) will not result in the overflow container being able to move the breaker throw 1008. In order to properly direct the force of the overflow container as it increases in weight, through the harness 1012 to the breaker throw 1008, a pulley 1010 is provided on the air handler unit. The harness 1012 runs over the pulley 1010 and redirects the vertical force of the weight of the overflow container to a horizontal force in opposition to the resistance of the breaker throw 1008 to move from the ON position to the OFF position. The weight of the overflow container creates a tension force in the harness 1012 below the pulley 1010 in a vertical direction as indicated by arrow 1014. Since the pulley 1010 is free to rotate, as indicated by arrow 1016, the force is translated to the horizontal portion of the harness 1012 as indicated by arrow 1018. Once the weight in the overflow container is sufficient, the force will pull the breaker throw 1008 to the OFF position, thereby shutting off the air conditioner system. As the breaker throw 1008 moves, the pulley 1010 will rotate correspondingly.

In some embodiments the breaker 1006 is located on a side 1004 of the air handler, rather than on the front 1002 (here in a plane perpendicular to the page of the drawing in FIG. 10). However a pulley 1010 can be equally used when the breaker 1006 is vertically oriented on the front of the air handler unit as well. The pulley 1010 comprises a wheel having a guide track about its circumference, and is mounted, at the center of the wheel, on an axle or spindle which is operably mounted on the sheet metal housing of the air handler unit. Furthermore, as with using levers to provide a mechanical advantage, it will be appreciated that a pulley system can achieve a similar mechanical advantage. For example, a portion of the harness connected to the overflow container can be routed around a large pulley wheel that is directly coupled to a smaller pulley wheel that is further connected through another portion of the harness to the breaker throw. This creates a similar leverage advantage as with using a long lever member to move a shorter lever member.

It will be appreciated by those familiar with air handler installations that air handlers are installed and positioned in a variety of different configurations. The air handler unit 100 of FIG. 1, for example, represents one common configuration where the air handler is located in a closet, in an upright position, raised above a floor, inside a structure, and the main breaker is located on the front of the air handler unit. Air handler units, as is known, can be installed in other places in a structure, including in an attic, in a garage, in a basement, and so on. Further, it is known that air handler units can be arranged in other configurations besides the vertically stacked arrangement of FIG. 1 with the upper and lower sections arranged one over the other. It is also known, for example, that air handler units can be arranged in a side by side configuration with the intake fan and expansion coil at the same level, for example. Further, it is known that the drainage structures can have varying arrangements relative to the a floor. The inventive embodiments can be adapted to most air handler configurations. An overflow conduit is arranged on the air handler such that if the drain becomes obstructed, water will flow through the overflow conduit into the overflow container. If a float switch is present, then the overflow conduit should be mounted such that water flows through it only when the water level reaches a level that indicates the float switch has failed. The weight of the water in the overflow container is transmitted through the harness and any mechanical advantage system to the breaker throw. When the force of the weight overcomes the resistance of the breaker throw to move, the breaker throw will switch from ON to OFF, thereby shutting off the air condition system. The overflow container can be pre-weighted to bias the breaker throw so that a only a small amount of water is needed to cause the breaker throw to move.

The inventive embodiments provide for an air conditioner shut-off system that provides a hard shut off by removing electrical power to the air conditioner system. While standard overflow handling can provide soft shut-off, and restarts, it is contemplated that these primary means of addressing drainage obstruction causing water accumulation can fail. In response, the inventive shut-off system relies on water overflow to create a mechanical force that is directed to the throw of the main breaker of the air conditioner system. If enough water is accumulated in the suspended overflow container, the resulting force overcomes the mechanical resistance of the breaker throw to move and switch from the ON position to the OFF position. Thus, the inventive overflow shut-off system can prevent water overflow conditions that result in water damage to the structure. Water damage due to overflowing, obstructed drains can be substantial, and occurs despite shut-off systems such as float switches being present since they too often fail.

The claims appended hereto are meant to cover all modifications and changes within the scope and spirit of the present invention.

What is claimed is:

1. An air handler condensate overflow shutoff system, comprising:

an overflow conduit having a first end and a second end, the first end coupled to a drainage system of an air handler to receive water from the drainage system when water from the air handler accumulates to a preselected level, the second end being positioned lower than the first end;

an overflow container having an opening positioned under the second end of the overflow conduit;

a harness having a lower end and an upper end, the lower end coupled to the overflow container, the upper end operably coupled to a breaker throw of the air handler unit; and wherein the overflow container freely hangs on the lower end of the harness, and wherein the overflow container includes a lower volume portion that, when will filled with water, results in sufficient force being exerted on the breaker throw through the harness to cause the breaker throw to switch to an off position.

2. The system of claim 1, wherein the overflow container further includes a upper volume portion in which water is accumulated after the breaker throw has been switched to the off position.

3. The system of claim 2, wherein the lower volume portion includes a horizontal extension that extends horizontally relative to the upper volume portion.

4. The system of claim 1, wherein the upper end of the harness is operably coupled to the breaker throw by a lever.

5. The system of claim 4, wherein the lever extends outward from the breaker throw.

6. The system of claim 4, wherein the lever is a double member, double action lever positioned along a front of the air handler and to a side of the breaker throw, the double action, double throw lever having at least two movable lever segments that are intercoupled including a first lever segment coupled to the upper end of the harness and an end segment coupled to the breaker throw.

7. The system of claim 1, wherein the breaker throw is oriented vertically, the system further comprises at least one pulley mounted on the exterior housing of the air handler over which the harness passes to redirect a vertical force created by the overflow container into a horizontal force against the breaker throw.

8. An air conditioning system having a drain overflow shut-off, comprising:

an air handler having an exterior housing and an exposed breaker, the exposed breaker having a breaker throw moveable from an ON position to an OFF position in response to a force applied to the breaker throw in a direction of movement of the breaker throw, the air handler further having a drainage system for draining condensate produced by a coil of the air handler;

an overflow conduit having a first end and a second end, the first end coupled to the drainage system of an air handler to receive water from the drainage system when water from the air handler accumulates in the drainage system to a preselected level, the second end being positioned lower than the first end;

an overflow container having an opening positioned under the second end of the overflow conduit;

a harness having a lower end and an upper end, the lower end coupled to the overflow container, the upper end operably coupled to the breaker throw of the air handler; and wherein the overflow container is coupled to the lower end the harness, and wherein when the overflow container receives a sufficient amount of water from the overflow conduit, a resulting force from a weight of the water is exerted on the breaker throw through the harness that causes the breaker throw to switch to the OFF position.

9. The air conditioning system of claim 8, wherein the harness is attached to the overflow container at a top of the overflow container at at least two points.

10. The air conditioning system of claim 8, wherein the overflow container includes a weight.

11. The air conditioning system of claim 8, wherein the upper end of the harness is operably coupled to the breaker throw by a lever.

12. The air conditioning system of claim 11, wherein the lever extends outward from the breaker throw.

13. The air conditioning system of claim 11, wherein the lever is a double member, double action lever positioned along a front of the air handler and to a side of the breaker throw, the double action, double throw lever having at least two movable lever segments that are intercoupled including a first lever segment coupled to the upper end of the harness and an end segment coupled to the breaker throw.

14. The air conditioning system of claim 8, wherein the breaker throw is oriented vertically, the system further comprises at least one pulley mounted on the exterior housing of the air handler over which the harness passes to redirect a vertical force created by the overflow container into a horizontal force against the breaker throw.

15. The air conditioning system of claim 8, wherein the overflow container further includes a upper volume portion in which water is accumulated after the breaker throw has been switched to the off position.

16. The air conditioning system of claim 15, wherein the lower volume portion includes a horizontal extension that extends horizontally relative to the upper volume portion.

17. A method of shutting off an air conditioner system, comprising:

coupling an overflow conduit, having a first end and a second end, to an air handler unit of the air conditioner system, the first end coupled to a drainage system of the air handler unit to receive water from the drainage system when water from the air handler unit accumulates to a preselected level, the second end being positioned lower than the first end;

mounting an overflow container under the second end of the overflow conduit such that an opening of the overflow container is positioned under the second end of the overflow conduit;

coupling a lower end of a harness to the overflow container;

operably coupling an upper end of the harness to a breaker throw of an electrical circuit breaker of the air conditioner system that is positioned at a front panel of the air handler unit; and accumulating water in the overflow container from the drainage system of the air handler to a mass sufficient to create a force on the breaker throw, through the harness, to cause the breaker throw to switch to an OFF position.

18. The method of claim 17, wherein the air handler unit includes a float switch, coupling the first end of the overflow conduit to the drainage system of the air handler unit comprises coupling the first end of the overflow conduit at a level such that water only flows into the first end of the overflow conduit when a water level in the drainage system is above a level necessary to trip the float switch.

19. The method of claim 17, wherein operably coupling the upper end of the harness to the breaker throw comprises coupling the upper end of the harness to a lever that is operably coupled to the breaker throw.

20. The method of claim 17, wherein operably coupling the upper end of the harness to the breaker throw comprises providing a pulley on the air handler unit and routing the upper end of the harness over the pulley to the breaker throw.

* * * * *